US007588675B2

(12) United States Patent
Fels et al.

(10) Patent No.: US 7,588,675 B2
(45) Date of Patent: Sep. 15, 2009

(54) IRON-PHOSPHORUS ELECTROPLATING BATH AND METHOD

(75) Inventors: Carl Christian Fels, Hottrop (DE); Shoichi Kamiya, Tokyo (JP); Allen R. Jones, Weddington, NC (US)

(73) Assignee: Atotech Deutschland GmbH, Berlin (DE)

( * ) Notice: Subject to any disclaimer, the term of this patent is extended or adjusted under 35 U.S.C. 154(b) by 0 days.

(21) Appl. No.: 12/342,468

(22) Filed: Dec. 23, 2008

(65) Prior Publication Data

US 2009/0101515 A1 Apr. 23, 2009

Related U.S. Application Data

(62) Division of application No. 10/790,365, filed on Mar. 1, 2004, now Pat. No. 7,494,578.

(51) Int. Cl.
*C25D 3/56* (2006.01)
*C23C 18/32* (2006.01)

(52) U.S. Cl. ..... 205/258; 205/259; 106/1.27

(58) Field of Classification Search ..... 205/258, 205/259; 106/1.27
See application file for complete search history.

(56) References Cited

U.S. PATENT DOCUMENTS

| | | | | |
|---|---|---|---|---|
| 3,086,927 | A | 4/1963 | Chessin et al. | 204/43 |
| 4,101,389 | A | 7/1978 | Uedaira | 204/44 |
| 4,533,441 | A | 8/1985 | Gamblin | 204/3 |
| 4,629,659 | A | 12/1986 | Kyono et al. | 428/659 |
| 4,746,412 | A * | 5/1988 | Uchida et al. | 205/109 |
| 4,968,391 | A | 11/1990 | Saito et al. | 204/27 |
| 5,861,413 | A | 1/1999 | Habich et al. | 514/312 |
| 7,494,578 | B2 * | 2/2009 | Fels et al. | 205/258 |
| 2003/0116442 | A1 | 6/2003 | Meyer et al. | 205/270 |

FOREIGN PATENT DOCUMENTS

| | | |
|---|---|---|
| JP | 60131993 | 7/1985 |
| JP | 60131999 | 7/1985 |
| JP | 08317108 | 11/1996 |
| JP | 08352980 | 12/1996 |
| JP | 10140388 | 5/1998 |
| WO | 01/31093 A1 | 3/2001 |
| WO | 01/66830 A3 | 9/2001 |

OTHER PUBLICATIONS

International Search Report and Written Opinion; Application No. PCT/US2005/000791; mailed Feb. 21, 2006.

Wang et al; Materials Transactions; Relationship between the Crystallographic Structure of Electrodeposited Fe-P Alloy Film and its Thermal Equilibrium Phase Diagram; vol. 44, No. 1 (2003) pp. 127-132.

* cited by examiner

*Primary Examiner*—Edna Wong
(74) *Attorney, Agent, or Firm*—Renner, Otto, Boisselle & Sklar, LLP

(57) ABSTRACT

In one embodiment, this invention relates to an aqueous acid iron phosphorus bath which comprises (A) at least one compound from which iron can be electrolytically deposited, (B) hypophosphite ion, and (C) sulfur-containing compound represented by the formula $$Y—S—R^1—SO_3X \qquad I$$

wherein X is H or an alkali metal, $R^1$ is an alkylene group containing from 1 to about 5 carbon atoms, Y is H, $S—R^1—SO_3X$, $C(S)NR_2''$, $C(S)OR''$, $C(NH_2)NR_2''$, or a heterocyclic group, and each R" is independently H, or an alkyl group containing from 1 to about 5 carbon atoms. Optionally, the aqueous acidic iron phosphorus electroplating bath of the invention also may comprise aluminum irons. The alloys which are deposited on the substrates by the process of the present invention are characterized by the presence of iron, phosphorus and sulfur.

19 Claims, No Drawings

IRON-PHOSPHORUS ELECTROPLATING BATH AND METHOD

CROSS-REFERENCE TO RELATED APPLICATION

The present application is a division of and claims priority under 35 U.S.C. §120 to commonly owned U.S. application Ser. No. 10/790,365, filed 1 Mar. 2004, now issued as U.S. Pat. No. 7,494,578 the entirety of which is hereby incorporated herein by reference.

TECHNICAL FIELD OF THE INVENTION

This invention relates to iron-phosphorus electroplating baths and to durable alloys electrodeposited from such baths.

BACKGROUND OF THE INVENTION

Electroplated iron-phosphorus films generally have a higher hardness than electroplated iron films. Accordingly, it has been known to plate aluminum alloy pistons, cylinders, etc. with an iron phosphorus alloy to improve the abrasion resistance and galling resistance of these articles. Iron-phosphorus electroplating baths which have been known in the prior art generally comprise a ferrous ion, a hypophosphorus acid or a hypophosphite salt, and may contain other optional materials such as boric acid, aluminum chloride, ammonium chloride, complexing agents, etc. One of the difficulties associated with many of the iron-phosphorus electroplating baths described in the prior art is cracking of the deposited alloy and loss of adhesion to the substrate. The presence of cracks in the alloy results in reduced hardness and also tends to reduce the toughness of the alloy coated work piece. Accordingly, it would be desirable to develop an iron phosphorus electroplating bath which would produce alloy deposits which exhibit little or no cracking or loss of adhesion on annealing.

SUMMARY OF THE INVENTION

In one embodiment, this invention relates to an aqueous acid iron phosphorus bath which comprises (A) at least one compound from which iron can be electrolytically deposited, (B) hypophosphite ion, and (C) a sulfur-containing compound selected from sulfoalkylated polyethylene imines, sulfonated safranin dye, and mercapto aliphatic sulfonic acids or alkali metal salts thereof.

Optionally, the aqueous acidic iron phosphorus electroplating bath of the invention also may comprise aluminum ions.

The invention also relates to a process for electrodepositing an iron-phosphorus alloy on a conductive substrate which comprises (A) providing an aqueous acidic electroplating bath as described above, and (B) effecting the electro deposition of the alloy on the substrate through the use of said electroplating bath. The alloys which are deposited on the substrates by the process of the present invention are characterized by the presence of iron, phosphorus and sulfur.

DESCRIPTION OF THE INVENTION

In one embodiment, the invention relates to an aqueous acidic iron phosphorus bath comprising (A) at least one compound from which iron can be electrolytically deposited, (B) hypophosphite ion, and (C) a sulfur-containing compound selected from sulfoalkylated polyethylene imines, sulfonated safranin dye, and mercapto aliphatic sulfonic acids or alkali metal salts thereof.

The source of iron in the electroplating bath can be any of those sources of iron known to the art such as ferrous sulfate, ferrous chloride, ferrous fluoroborate, ferrous sulfamate, ferrous methane sulfonate, and mixtures thereof. In one embodiment, the source of iron is a mixture of ferrous chloride and ferrous sulfate. The amount of ferrous ions in the plating baths should be in the range of from about 20 grams to about 120 grams per liter or from about 0.5 molar to as high as the saturation limit for ferrous ion and the plating bath which may be up to about 2 molar ferrous iron. In another embodiment, the concentration of the ferrous ions in the plating bath is from about 20 to about 80 grams per liter of the bath.

Hypophosphorous acid ($H_3PO_2$) and alkali metal hypophosphites are useful as sources of hypophosphite ions in the electroplating baths of the present invention. In one embodiment, the source of hypophosphite ion in the bath is a mixture of hypophosphorus acid and an alkali metal hypophosphite salt. Examples of useful hypophosphite salts include the sodium salt ($NaH_2PO_2$), the potassium salt ($KH_2PO_2$), etc. The concentrations of the hypophosphite ion in the plating bath of the present invention determines the amount of phosphorus in the iron-phosphorus alloy deposited from the plating bath. The amount of hypophosphorus acid or alkali metal hypophosphite salts contained in the bath may vary from about 0.01 to about 15 grams per liter, and the amount of phosphorus contained in the plating baths of the present invention may range from about 0.2 to about 8 grams of phosphorus per liter of the plating bath. In another embodiment, the total of hypophosphite ion and hypophosphorus acid in the plating bath may be between about 0.005 and 0.1 molar, and in yet another embodiment, from about 0.01 to about 0.07 molar. The particular amount of hypophosphorous acid and hypophosphite included in the electroplating bath varies with the desired phosphorus content of the deposited iron-phosphorus alloys.

As noted above, the aqueous acidic iron phosphorus baths of the present invention also contain a sulfur-containing compound selected from sulfoalkylated polyethylene imines and mercapto aliphatic sulfonic acids or alkali metal salts thereof. It has been discovered than when these sulfur-containing compounds, as described more fully below, are incorporated into the electroplating baths, superior iron-phosphorus alloys are deposited from the bath onto conductive substrates, and these improved alloys are obtainable with the electroplating baths of the present invention which may be free of complexing agents ordinarily utilized in prior art electroplating baths. In one embodiment, the mercapto aliphatic sulfonic acids and alkali metal salts may be represented by the formula $$Y—S—R^1—SO_3X \qquad \text{I}$$

wherein X is H or an alkali metal, $R^1$ is an alkylene group containing from 1 to about 5 carbon atoms, Y is H, $S—R^1—SO_3X$, $C(S)NR_2''$, $C(S)OR''C(NH_2)NR_2''$, or a heterocyclic group, and each R" is independently H or an alkyl group containing from 1 to about 5 carbon atoms.

In another embodiment $R^1$ is H or an alkylenic group containing 1 to 3 carbon atoms and R" is H or a methyl group. In another embodiment, the sulfur-containing compound is a mercapto aliphatic sulfonic acid, an alkali metal salt thereof, or a mixture thereof.

A variety of useful mercapto aliphatic sulfonic acids and alkali metal salts thereof are available from Raschig. Specific examples include mercapto propyl sulfonic acid sodium salt (identified as MPS); bis-(sodium sulfopropyl)-disulfide (SPS); N,N-dimethyl-dithiocarbamyl propyl sulfonic acid, sodium salt (DPS); 3-(benzothiazolyl-2-mercapto)-propyl sulfonic acid, sodium salt (ZPS); (O-ethyl dithiocarbonato)-S-(3-sulfopropyl)-ester, potassium salt (OPX); 3-S-isothiuronium propyl sulfonate (UPS). The sulfur-containing compound added to the iron phosphorus electroplating baths of the invention also may be a sulfopropylated polyethylene imine available, for example, as an aqueous solution under the designation Leveller 135 CU from Raschig. Another useful sulfur-containing compound is sulfonated safranin dye available, for example from Clariant.

The amount of the sulfur-containing compound contained in the electroplating baths of the present invention may vary from about 0.001 to about 0.5 grams per liter of bath. In another embodiment, the amount of sulfur containing compound in the electroplating bath may range from about 0.01 to about 0.1 gram per liter of bath.

In another embodiment, the electroplating baths of the invention may also comprise aluminum ions. Examples of aluminum ion sources which may be included in electroplating baths include aluminum sulfate, aluminum chloride, etc. The amount of aluminum ion which may be present in the plating baths of the invention may range from about 0.1 to about 10 grams per liter of bath. In another embodiment, the electroplating baths may contain from about 1 to about 5 grams per liter of aluminum ions.

The electroplating baths of the present invention may contain compounds which act as complexing agents and/or stabilizers. However, one of the characteristics of the plating baths of this invention is that alloy deposits having excellent properties can be obtained without any stabilizers or complexing agents in the baths. In some instances, stabilizers and complexing agents known in the art may be included in the baths. Examples of such compounds include glycine, B-alanine, DL-alanine, succinic acid, L-ascorbic acid, gluconic acid, oxalic acid, etc.

The plating baths of the present invention may further contain one or more water-insoluble materials selected from metals, water-insoluble inorganic and organic fine particulates, and fibers. Examples of the water-insoluble materials include finely divided metal powders such as powders of Pb, Sn, Mo, Cr, Si, Mo—Ni, Al—Si, Fe—Cr, Pb—Sn, Pb—Sn—Sb, Pb—Sn—Cu, etc.; oxides such as $Al_2O_3$, $SiO_2$, $ZrO_2$, $TiO_2$, $ThO_2$, $Y_2O_3$, $CeO_2$, etc.; nitrides such as $Si_3N_4$, TiN, BN, CBN, etc.; carbides such as TiC, WC, SiC, $Cr_3C_2$, $B_4C$, ZrC, etc.; borides such as $ZrB_2$, $Cr_3B_2$, etc.; carbon allotropes such as fluorinated graphite and nanodiamond; sulfides such as $MoS_2$; other inorganic fine particulates; fluoride resins such as polytetrafluoroethylene, epoxy resins, and rubber latexes; other organic fine particulates; and glass fibers, carbon fibers including nanotubes, various metal whiskers, and other inorganic and organic fibers including metal-polymer amphiphiles. Among them, hard or lubricating materials may be used particularly when it is intended to plate slide members. An example of a useful fluoride resin powder is Fluoro A650 an aqueous polytetrafluoroethylene dispersion from Shamrock Technical Incorporated.

The fine particulates used in the practice of the present invention may preferably have a mean particle size of 0.01 to 200 μm, more preferably 0.1 to 20 μm, and the fibers may preferably be 0.01 to 2000 μm long, more preferably 0.1 to 60 μm long. The particulates and/or fibers may preferably be added to the plating bath in an amount of 5 to 500 gram/liter, more preferably 20 to 100 gram/liter.

The plated film obtained from a composite plating bath having dispersed particulates or fibers as described above has an iron-phosphorus deposit as a matrix phase in which the particulates or fibers are codeposited and dispersed. The codeposited particulates or fibers add their inherent properties to the overall film while the matrix phase of iron-phosphorus deposit maintains its own good mechanical properties.

Further, a water-soluble titanium compound and/or zirconium compound may be added to the plating baths of the present invention to produce composite plated films having improved abrasion resistance. The titanium and zirconium compounds used herein may be, for example, $Na_2TiF_6$, $K_2TiF_6$, $(NH_4)_2TiF_6$, $Ti(SO_4)_2$, $Na_2ZrF_6$, $K_2ZrF_6$, $(NH_4)_2ZrF_6$, $Zr(SO_4)_2.4H_2O$, etc. and mixtures thereof. The amount of the titanium or zirconium compounds added may be 0.05 to 10 grams, more preferably 0.1 to 5 grams calculated as elemental titanium or zirconium per liter of the plating solution. Smaller amounts of the titanium or zirconium compounds are not effective in improving the abrasion resistance of the resulting plated film. Larger amounts cause the titanium or zirconium compounds to be suspended in the bath rather than dissolved and thus adhere to the plated film surface to give a gritty texture detracting from the appearance and abrasion resistance.

The pH of the electroplating baths of the present invention during plating should be between about 0.5 to about 5. In other embodiments, the pH of the plating bath during plating may range from about 0.8 to about 2.5 or from about 1.5 to about 2.0. In one embodiment, the temperature of the bath during plating is between about 10 and 80° C., and more often, is from about 40 to about 60° C.

Useful iron-phosphorus alloys can be deposited from the plating baths of the present invention over a wide range of current densities. In one embodiment, the alloys are deposited from the electroplating baths of the present invention at a current density of from about 0.5 to about 300 A/dm$^2$ or from about 50 to about 100 A/dm$^2$.

The thickness of the iron phosphorus alloys deposited from the electroplating baths of the invention may range from about 1 to about 250 microns, and in another embodiment, from about 10-150 microns.

The following examples illustrate the electroplating baths of the present invention unless otherwise indicated in the examples, all parts and percentages are by weight, temperatures are in degrees centigrade and pressure is at or near atmospheric pressure. The examples are illustrative and are not intended to be limiting in scope.

| | g/l |
|---|---|
| Example 1 | |
| $FeS0_4 \cdot 7H_2O$ | 400 |
| $FeCl_2 \cdot 4H_2O$ | 80 |
| $H_3PO_2$ | 2.24 |
| MPS | 0.05 |
| Water | Remainder |
| Example 2 | |
| $FeSO_4 \cdot 7H_2O$ | 300 |
| $FeCl_3 \cdot 4H_2O$ | 60 |
| $H_3PO_2$ | 2 |
| MPS | 0.05 |
| Water | Remainder |

-continued

| | g/l |
|---|---|
| Example 3 | |
| Ferrous fluoroborate | 60 |
| $FeS0_4 \cdot 7H_2O$ | 400 |
| $H_3PO_2$ | 8 |
| SPS | 0.05 |
| Water | Remainder |
| Example 4 | |
| $FeSO_4 \cdot 7H_2O$ | 300 |
| $FeCl_2 \cdot 4H_2O$ | 60 |
| $H_3PO_2$ | 1 |
| MPS | 0.05 |
| $Al_2(SO_4)_3 \cdot 18H_2O$ | 60 |
| Water | Remainder |
| Example 5 | |
| $FeSO_4 \cdot 7H_2O$ | 300 |
| $Na \cdot H_2PO_2 \cdot H_2O$ | 3 |
| $H_3PO_2$ | 4 |
| DPS | 0.03 |
| Water | Remainder |
| Example 6 | |
| $FeSO_4 \cdot 7H_2O$ | 300 |
| $FeCl_3 \cdot 4H_2O$ | 50 |
| $H_3PO_2$ | 3 |
| SPS | 0.06 |
| $Al_2(SO_4)_3 \cdot 18H_2O$ | 60 |
| Example 7 | |
| $FeSO_4 \cdot 7H_2O$ | 400 |
| $FeCl_2 \cdot 4H_2O$ | 80 |
| $H_3PO_2$ | 2.24 |
| MPS | 0.05 |
| $TiO_2$ | 2 |
| Water | Remainder |
| Example 8 | |
| $FeSO_4 \cdot 7H_2O$ | 400 |
| $FeCl_2 \cdot 4H_2O$ | 80 |
| $H_3PO_2$ | 2.24 |
| MPS | 0.05 |
| SiC | 2 |
| Water | Remainder |
| Example 9 | |
| $FeSO_4 \cdot 7H_2O$ | 400 |
| $FeCl_2 \cdot 4H_2O$ | 80 |
| $H_3PO_2$ | 2.24 |
| MPS | 0.05 |
| $MoS_2$ | 2 |
| Water | Remainder |
| Example 10 | |
| $FeSO_4 \cdot 7H_2O$ | 400 |
| $FeCl_2 \cdot 4H_2O$ | 80 |
| $H_3PO_2$ | 2.24 |
| MPS | 0.05 |
| Fluoro A650 | 2 |
| Water | Remainder |

| Examples (g/l) | 11 | 12 | 13 | 14 | 15 |
|---|---|---|---|---|---|
| $FeSO_4 \cdot 7H_2O$ | 400 | 400 | 400 | 400 | 400 |
| $FeCl_2 \cdot 4H_2O$ | 80 | 80 | 80 | 80 | 80 |
| $H_3PO_2$ | 1.56 | 1.65 | 2.31 | 3.17 | 4.29 |
| MPS | 0.05 | 0.05 | 0.05 | 0.05 | 0.05 |
| Water | Remainder | Remainder | Remainder | Remainder | Remainder |

In one embodiment, the plating baths of this invention are useful for depositing an iron-phosphorus alloy on a variety of conductive substrates including iron, steel, aluminum alloys, etc. Thus the plating baths of the invention are useful in depositing an iron-phosphorus alloy on small parts, laminated materials, plates, wire rods, slide members etc. A typical example of a slide member is a skirt of a piston which is operated for sliding in a base of a high silicon aluminum alloy cylinder. Slider materials include magnesium alloys, gray cast iron, spring steel, tool steel and stainless steel. Other examples of slide members which may be plated with the electroplating baths of the invention include pistons, piston rings, piston rods, bearings, bored cylinders, shafts, clutch housings, clutch diaphragms, springs, etc.

To demonstrate the improvements obtained with the baths of the present invention containing the sulfur-containing compounds, comparative plating baths are prepared similar to Examples 1 and 4 above but without the sulfur compound MPS.

| | g/l |
|---|---|
| Comparative Example 1 | |
| $FeSO_4 \cdot 7H_2O$ | 400 |
| $FeCl_3 \cdot 4H_2O$ | 80 |
| $H_3PO_2$ | 2.24 |
| Water | Remainder |
| Comparative Example 2 | |
| $FeSO_4 \cdot 7H_2O$ | 300 |
| $FeCl_3 \cdot 4H_2O$ | 60 |
| $H_3PO_2$ | 1 |
| $Al_2(SO_4)_3 \cdot 18H_2O$ | 60 |
| Water | Remainder |

Work pieces of 4032 aluminum alloy, or AISI O1 (UNS T 31501) oil hardening tool steel alloy rods (mandrels) with diameters between 0.8 and 1.2 cm, or six inch by 2.5 inch stationary cast aluminum ADC 12 alloy panels are electroplated with the plating baths of examples 1 and 4 and Comparative Example 1 and Comparative Example 2 at a temperature of about 50° C. with an applied direct current density of 10 A/dm$^2$. The mandrels are rotated at about 1000 rpm to provide solution speeds of about 3.6 m/minute, and the anodes are polypropylene bagged steel strips. In all the tests, the solution is continuously circulated with turnover rates of about 10 per hour.

Typical processing sequences for steel and aluminum are:

(1) sand mandrel sequentially with 320, 400 and 600 grit sandpaper, (2) weigh mandrel, (3) tape areas that will not be plated, and carefully measure the area that will be plated, (4) prepare steel mandrels for plating by standard immersion in a hot alkaline electrocleaner followed by cold-water rinse (CWR), brief immersion in a dilute hydrochloric acid solution, and a second CWR, (5) prepare aluminum mandrels and panels for plating by a standard double zincate treatment.

After plating is completed, the mandrels or panels are removed, rinsed, the tape removed, dried and then reweighed. Alloy morphology is observed by scanning electron microscope (SEM), composition is measured by energy dispersive spectroscopy (EDS) and in some cases by x-ray photoelectron spectroscopy or proton induced x-ray immision. Current efficiency is calculated based upon determining the theoretical weight gain from the measured alloy composition and the weight that the measured product of current and time would produce for such an alloy using Faraday's law and the tables in Modern Electroplating, $4^{th}$ Edition. Crack counts are obtained by observing the surface using optical microscopy (OM). The alloy phases are determined by x-ray powder defractometer $CU_{ka}$ x-ray source. Adhesion is assessed by striking coupons or mandrels against a rotating sharp grinder and observing how much non-struck substrate is exposed adjacent to the struck substrate, or by heating the coupons to 300° C., quenching them into room temperature water, and observing the coating for signs of blistering or other decohesion. The thicknesses of the deposits are obtained by metallographic cross section, and hardness is determined by measuring the cross sectioned coating with a microhardness tester. The OM and SEM are obtained of representative cross sections.

To assess the affect of the sulfur-modified electroplating baths to the Comparative Examples not containing the sulfur-containing compounds, several tests are performed where the mandrels or panels are tested before and after annealing. In all cases, the annealing furnace is pre-heated, samples are introduced and remain at the indicated temperature for 30 minutes. The samples are then withdrawn from the furnace and allowed to ballistically cool in a room temperature environment placed on top of a Kimax watch glass. The Vickers hardness of the deposit is determined. The results of these tests are summarized in Table I. As can be seen from the results, the initial hardness of the deposits obtained with the baths of Example 1 and Example 4 is higher than the hardness obtained in the Comparative Examples containing no sulfur compound. When the deposits of the Comparative Examples are annealed, there is a significant increase in hardness. In contrast, annealing of the deposits obtained from the baths of Examples 1 and 4 does not result in a significant increase in hardness.

TABLE I

Hardness Values (kg/mm$^2$) as Function of Annealing Temperature

| | | Annealing Temperature (° C.) | | |
|---|---|---|---|---|
| Deposit of | Initial | 300 | 350 | 500 |
| Example 1 | 887.4 | 1015.2 | 1022 | 870 |
| Comparative Example 1 | 719.6 | 1111 | 1006 | 1075 |
| Example 4 | 679.2 | 790.2 | 699.8 | 653 |
| Comparative Example 2 | 445 | 713.6 | 732.2 | 725 |

As mentioned above, the alloys which are deposited from the electroplating baths of the present invention contain iron, phosphorus and sulfur. The amount of phosphorus observed in the alloy varies directly with the amount of hypophosphite contained in the solution and the current density. This can be seen from the results of the experiments and tests with the electroplating baths of the invention containing varying amounts of hypophosphite. In Examples 11-15, the plating bath prepared as in Example 1 is modified to contain amounts of phosphorus varying from 0.016 to 0.065 moles per liter, and the electroplating on aluminum 4032 rods or mandrels is carried out at 3 different current densities: 10 A/dm$^2$; 20 A/dm$^2$ and 30 A/dm$^2$. The deposits obtained are analyzed for percent phosphorus. The results which are summarized in Table II indicate that the phosphorus content of the deposits varies with the hypophosphite concentration in the electroplating bath. The results also demonstrate that the hardness of the deposit generally increases with increasing phosphorus contents at the levels studied.

TABLE II

Variation in P Content in Deposit is $H_3PO_4$ Concentration on Bath and Current Density

| Current Density Hardness A/dm$^2$ | Bath of Example | Bath P Content moles/liter | P in Deposit % w | Vickers (Kg/mm$^2$) |
|---|---|---|---|---|
| 10 | 11 | 0.016 | 3.4 | 946 |
| | 12 | 0.025 | 4.7 | 1097 |
| | 13 | 0.035 | 5.3 | 1128 |
| | 14 | 0.048 | 7.3 | 767 |
| | 15 | 0.065 | 6 | 1032 |
| 20 | 11 | 0.016 | 2.2 | 843 |
| | 12 | 0.025 | 2.9 | 823 |
| | 13 | 0.035 | 3.8 | 1064 |
| | 14 | 0.048 | 5.1 | 1168 |
| | 15 | 0.065 | 4.3 | 1064 |
| 30 | 11 | 0.016 | 2.3 | 866 |
| | 12 | 0.025 | 2.4 | 835 |
| | 13 | 0.035 | 2.9 | 919 |
| | 14 | 0.048 | 4.2 | 1081 |
| | 15 | 0.065 | 5.2 | 990 |

In one embodiment, the iron-phosphorus alloys which are obtained utilizing the electroplating baths of the present invention contain from about 70 to about 99 atomic percent of iron, from about 1 to about 30 atomic percent of phosphorus and from about 0.1 to about 0.5 atomic percent of sulfur. In another embodiment, the alloy contains from about 92 to about 98% atomic percent of iron, from 1.7 to about 7.5 atomic percent of phosphorus and from about 0.1 to about 1.2 atomic percent of sulfur.

EDS is used to determine the phosphorus and sulfur concentration of a cross-sectioned deposit from the plating baths of Examples 1 and 4 deposited onto 4032 aluminum mandrels. The deposits obtained with the plating baths of Example 1 and Example 4 exhibit excellent uniformity throughout the cross section, and sulfur is detectable in the alloy. Confirmation of sulfur in the alloy is performed using proton induced x-ray immision spectroscopy (PIXE) and x-ray photoelectron spectroscopy (XPS).

The adhesion of the deposited alloy deposited from the baths of Examples 1 and 4 is improved by the presence of the aliphatic sulfur-containing compound MPS. This is demonstrated by comparing the adhesion of the deposit obtained from electroplating baths from the baths of Examples 1 and 4 to the deposits obtained with the bath of Comparative Example 1 and Comparative Example 2, respectively. Two types of adhesion are studied on the steel and aluminum mandrels. The first type of adhesion is observation of blistering following heating to 300° C. and plunging the hot rod and coating into water at about 10° C. The second adhesion test is observation of the distance from which the coating flakes away from the edge of a region that has been subjected to a grinding wheel. After some experimentation to obtain the best preparation cycle, comparison of the deposit from bath of Example 1 with the deposit from the bath of Comparative Example 1 indicates that over 85% of the steel or aluminum rods exhibit good adhesion whereas only 38% of the steel and aluminum rods coated with the bath of Comparative Example 1 exhibit good adhesion. Although the alloy deposited from the bath of Example 4 does not exhibit good adhesion on steel, good adhesion on aluminum mandrels with the plating bath of Example 4 is obtained in over 80% of the tests whereas good adhesion of the deposit with the bath of Comparative Example 2 is obtained in only 30% of the tests.

The crystallography of the alloy deposit obtained with the plating bath of Example 1 has been determined. Coupons that are coated with iron-phosphorus on the bath of Example 1 are observed using TEM XRPD and SEM, and the results indicate that the deposit is a mixture of a very fine grained 50-100 (nm) alpha iron in an amorphous FeP matrix. When this deposit is allowed to stand at room temperature without annealing for over one year, the deposit demonstrates a decrease in amorphous signal and an increase in alpha iron signal intensity when measured using a standard x-ray powder diffractometer and compared to fresh deposits. Both fresh and room temperature aged deposits show dramatic changes in crystallography after annealing. Annealing studies are carried out at temperatures of 200° C., 350° C., 500° C. and 600° C. Samples annealed at temperatures above 350° C. with annealing times in excess of 30 minutes followed by cooling, do not exhibit further crystallographic changes.

It has also been demonstrated that microcracking of the deposit is affected by the presence of the sulfur-containing compound in the electroplating baths. When the sulfur containing compound is absent (Comparative Examples 1 and 2) the iron-phosphorus deposits, after annealing, have large increases in crack count and, cross sections of the surfaces demonstrate that the cracks after annealing are much wider and often expose the substrate. The deposits obtained with the electroplating baths of the present invention, for example, Example 1 and Example 4, do not show a variation in the crack count after annealing, the average crack widths are not increased, and cracks extending from surface to substrate are rare.

It also has been discovered that the presence of the sulfur-containing compounds in the plating baths of the present invention as described above provides the bath with improved stability. The plating baths of the invention, after electrolysis, do not exhibit any variation in color or pressure (signs of decomposition) on storing. In contrast, the plating bath of Comparative Examples 1 and 2 which have been subjected to electrolysis show significant oxidation of the ferrous ion to ferric ion on standing.

While the invention has been explained in relation to its various embodiments, it is to be understood that other modifications thereof will become apparent to those skilled in the art upon reading the specification. Therefore, it is to be understood that the invention disclosed herein is intended to cover such modifications as fall within the scope of the appended claims.

The invention claimed is:

1. An aqueous acidic iron phosphorus bath comprising:

(A) at least one compound from which iron can be electrolytically deposited, (B) hypophosphite ion, and (C) a sulfur-containing compound represented by the formula $$Y—S—R^1—SO_3X \qquad I$$

wherein X is H or an alkali metal, $R^1$ is an alkylene group containing from 1 to about 5 carbon atoms, Y is H, $S—R^1—SO_3X$, $C(S)NR_2''$, $C(S)OR''$, $C(NH_2)NR_2''$, or a heterocyclic group, and each R" is independently H or an alkyl group containing from 1 to about 5 carbon atoms.

2. The bath of claim 1 wherein the iron compound is selected from ferrous chloride, ferrous sulfate, ferrous fluoroborate, ferrous methane sulfonate, ferrous sulfamate and mixtures thereof.

3. The bath of claim 1 wherein a source of hypophosphite ion is hypophosphorus acid, an alkali metal hypophosphite salt, or a mixture thereof.

4. The bath of claim 1 wherein the sulfur-containing compound is mercapto propyl sulfonic acid sodium salt (MPS); bis-(sodium sulfopropyl)-disulfide (SPS); N,N-dimethyl-dithiocarbamyl propyl sulfonic acid, sodium salt (DPS); 3-(benzothiazolyl-2-mercapto)-propyl sulfonic acid, sodium salt (ZPS); (O-ethyl dithiocarbonato)-S-(3-sulfopropyl)-ester, potassium salt (OPX); 3-S-isothiuronium propyl sulfonate (UPS), or a mixture of any two or more thereof.

5. The bath of claim 1 further comprising aluminum ions.

6. The bath of claim 1 wherein the bath has a pH from about 0.5 to about 5.

7. The bath of claim 1 wherein the bath is free of complexing agents.

8. The bath of claim 1 wherein a source of ferrous ion comprises a mixture of ferrous sulfate and ferrous chloride.

9. A process for electrodepositing an iron-phosphorus alloy on a conductive substrate which comprises:

(A) providing the acidic aqueous bath of claim 1, and (B) effecting the electrodeposition of the alloy on the substrate through the use of said bath.

10. The process of claim 9 wherein the substrate is a cylinder of an internal combustion engine.

11. An aqueous acidic iron phosphorus electroplating bath comprising:

(A) from about 20 to about 120 grams per liter of ferrous ion, (B) from about 0.2 to about 8 grams per liter of phosphorus, said phosphorus being supplied as hypophosphite ion, and (C) from about 0.001 to about 0.5 grams per liter of a sulfur-containing compound represented by the formula $$Y—S—R^1—SO_3X \qquad I$$

wherein X is H or an alkali metal, $R^1$ is an alkylene group containing from 1 to about 5 carbon atoms, Y is H, $S—R^1—SO_3X$, $C(S)NR_2''$, $C(S)OR''$, $C(NH_2)NR_2''$, or a heterocyclic group, and each R" is independently H or an alkyl group containing from 1 to about 5 carbon atoms.

12. The electroplating bath of claim 11 wherein the ferrous ion is present as at least one salt selected from ferrous chloride, ferrous sulfate, ferrous fluoroborate, ferrous methane sulfonate, ferrous sulfamate, and mixtures thereof.

13. The electroplating bath of claim 11 wherein the phosphorus is present as hypophosphorus acid, an alkali metal hypophosphite salt, or mixtures thereof.

14. The electroplating bath of claim 11 wherein the sulfur-containing compound is mercapto propyl sulfonic acid sodium salt (MPS); bis-(sodium sulfopropyl)-disulfide (SPS); N,N-dimethyl-dithiocarbamyl propyl sulfonic acid, sodium salt (DPS); 3-(benzothiazolyl-2-mercapto)-propyl sulfonic acid, sodium salt (ZPS); (O-ethyldithiocarbonato)-S-(3-sulfopropyl)-ester, potassium salt (OPX); 3- S-isothiuronium propyl sulfonate (UPS), or a mixture of any two or more thereof.

15. The electroplating bath of claim 11 wherein the bath further comprises from about 0.1 to about 10 grams per liter of aluminum ions.

16. The electroplating bath of claim 11 wherein the bath has a pH of from about 0.8 to about 2.5.

17. The electroplating bath of claim 11 wherein the bath is free of complexing agents.

18. A process for electrodepositing an iron-phosphorus alloy on a conductive substrate which comprises:

(A) providing the acidic aqueous electroplating bath of claim 11, and (B) effecting the electrodeposition of the alloy on the substrate through the use of said bath.

19. The process of claim 18 wherein the substrate is a cylinder of an internal combustion engine.

* * * * *